US006633135B2

(12) United States Patent
Nara et al.

(10) Patent No.: US 6,633,135 B2
(45) Date of Patent: Oct. 14, 2003

(54) APPARATUS AND METHOD FOR EVALUATING ORGANIC EL DISPLAY

(75) Inventors: Shouji Nara, Kanagawa Prefecture (JP); Masatoshi Itoh, Kanagawa Prefecture (JP); Makoto Ookuma, Kanagawa Prefecture (JP); Tomoharu Innami, Kanagawa Prefecture (JP)

(73) Assignee: Wintest Corporation (JP)

( * ) Notice: Subject to any disclaimer, the term of this patent is extended or adjusted under 35 U.S.C. 154(b) by 0 days.

(21) Appl. No.: 09/898,311

(22) Filed: Jul. 3, 2001

(65) Prior Publication Data

US 2002/0047565 A1 Apr. 25, 2002

(30) Foreign Application Priority Data

Jul. 28, 2000 (JP) ..... 2000-229519

(51) Int. Cl.[7] ..... G09G 3/10

(52) U.S. Cl. ..... 315/169.3; 315/169.1; 315/169.2; 345/904

(58) Field of Search ..... 315/169.3, 169.1, 315/169.2, 169.4; 345/904, 76, 204; 324/770, 537, 403

(56) References Cited

U.S. PATENT DOCUMENTS 5,235,272 A * 8/1993 Henley ..... 345/904
5,825,196 A * 10/1998 Irie et al. ..... 315/169.3
5,903,246 A * 5/1999 Dingwall ..... 324/770
6,034,479 A * 3/2000 Xia ..... 315/169.3
6,204,836 B1 * 3/2001 Yamazaki et al. ..... 345/98

FOREIGN PATENT DOCUMENTS

| | | |
|---|---|---|
| JP | 5-107561 | 4/1993 |
| JP | 9-260061 | 10/1997 |
| JP | 10-321367 | 12/1998 |
| JP | 2002 32035 | 1/2002 |

* cited by examiner

*Primary Examiner*—Don Wong
*Assistant Examiner*—Ephrem Alemu
(74) *Attorney, Agent, or Firm*—Ostrolenk, Faber, Gerb & Soffen, LLP

(57) ABSTRACT

It is an object of the present invention to provide an apparatus and method for evaluating an organic EL display, with which there is a simple drive circuit used for testing an organic EL display 10, evaluation of high reliability can be achieved, and an evaluation of the organic EL display 10 itself is performed prior to the installation of finished product drive circuits to the organic EL display 10, which makes it possible to suppress the decrease in yield caused by dealing with defective products due to the evaluation results. It was noticed that if the drive (testing) of a pixel 11 is performed during the discharge of the previous pixel 11 after the supply of drive current to that previous pixel 11, and if the difference between the drive current and discharge current values of the organic EL pixel 14 of the pixel 11 is under a specific level, then it is possible to decide that the pixels constituted by the various organic EL elements are operating normally, and the present invention is characterized in that pixel defects are detected by detecting the difference between drive current and discharge current values for every pixel 11 constituted by an organic EL element 1.

20 Claims, 7 Drawing Sheets

APPARATUS AND METHOD FOR EVALUATING ORGANIC EL DISPLAY

BACKGROUND OF THE INVENTION

1. Field of the Invention

The present invention relates to an apparatus and method for evaluating an organic electroluminescence display (hereinafter referred to as an "organic EL display") that makes use of an organic substance for its light-emitting substance, and more particularly relates to an apparatus and method for evaluating an organic EL display used in any of various types of display devices, such as the display panels of cellular telephones, the display panels of car audio systems, display panels for still or moving pictures, and the image displays of digital cameras.

2. Description of the Related Art

Organic electroluminescence elements (hereinafter referred to as "organic EL elements") have been the subject of considerable research and practical application in recent years.

FIG. 5 is an enlarged cross section of the main components of a conventional type of organic EL element 1. This organic EL element 1 comprises a glass substrate 2, an anode 3, a hole transport layer 4, an electron transport light-emitting layer 5 and a cathode 6. Direct current is supplied by applying a specific voltage between the anode 3 and the cathode 6 from a DC power supply 7.

A transparent electrode made of ITO (Indium Tin Oxide) or the like is employed for the anode 3, a diamine dielectric (TPAC) is employed for the hole transport layer 4, an aluminum complex (Alq) is employed for the electron transport light-emitting layer 5, and the carrier rebonding rate is raised by laminating materials with different carrier transport capabilities. Magnesium (Mg), aluminum (Al), or the like is employed for the cathode 6.

With an organic EL element 1 structured such as this, the carriers (hole and electron charges) injected from the anode 3 and the cathode 6 are confined in the organic layer of the electron transport light-emitting layer 5, the carrier rebonding efficiency rises sharply, and a high level of brightness (over 1000 cd/m$^2$) can be obtained at a voltage of 10 volts or less.

Such elements are therefore expected to find use in cellular telephones, car audio systems, household electronics, and so forth.

FIG. 6 is a circuit diagram illustrating one pixel 11 in an active matrix type of organic EL display 10. The organic EL display 10 comprises a plurality of selection lines VG (scanning lines) and signal lines 9VD) arrange din a matrix, with the pixel 11 connected at the intersection of these lines.

The pixel 11 comprises a switching circuit 12, a constant current circuit 13, and an organic EL pixel 14 constituted by the above-mentioned organic EL element 1. The organic EL pixel 14 emits light when supplied with a constant current by the application of a fairly constant specific voltage from a voltage supply line VLC to the constant current circuit 13.

The pixel 11 has been disclosed in Japanese Laid-Open Patent Application H5-107561 and elsewhere: for example as shown in FIG. 7, a first transistor 15 consisting of a thin film transistor (TFT) or the like is employed as the switching circuit 12, and a second transistor 16, similarly made of TFT or the like, and a capacitor 17 are employed as the constant current circuit 13.

The first transistor 15 is switched in order to supply a constant current to the organic EL pixel 14.

The second transistor 16 is switched by the first transistor and is connected to the organic EL pixel 14.

The capacitor 17 is selected to help supply a constant current to the organic EL pixel 14 according to the specific discharge time thereof.

With a pixel 11 structured such as this, the selection of the pixel 11 is made by the first transistor 15, the result of the selection is transmitted to the second transistor 16, the voltage applied to the pixel 11 is controlled by the second transistor 16 and by the capacitor 17, which is able to hold a specific electrical charge for a specific length of time, and a fairly constant specific voltage from the voltage supply line VLC is maintained, thereby reducing the difference in voltage between the various pixels 11.

In order to evaluate an organic EL display 10 structured such as this, in the past the organic EL display 10 was actually driven only after a drive circuit (not shown) was attached to the organic EL display 10 and everything put together in a form similar to that of an actual finished product, and the work of detecting line defects or dot defects was performed by separate image evaluation devices.

Therefore, a problem was that discrepancies occurred between the various evaluation devices or in the evaluation standards, and this led to lower detection accuracy.

Another method is for the drive or luminescence state of the organic EL display 10 to be visually evaluated by a human, but a problem was that there was variance in the evaluation results depending on the experience of the evaluator and how well he or she was performing on a given day.

Furthermore, if an element is decided to be defective as a result of evaluation, the organic EL display 10 ends up being discarded along with the above-mentioned drive circuit parts attached to it, which is a problem in that it is wasteful. This also results in a waste of the time spent in evaluation.

Organic EL elements have been disclosed in the above-mentioned Japanese Laid-Open Patent Application H5-107561, as well as in Japanese Laid-Open Patent Applications H9-260061 and H10-321367 and elsewhere.

SUMMARY OF THE INVENTION

The present invention was conceived in light of the above problems, and it is an object thereof to provide an apparatus and method for evaluating an organic EL display, with which the drive circuit used for testing the organic EL display has a simple circuit configuration, and which yields evaluation results of high reliability.

It is another object of the present invention to provide an apparatus and method for evaluating an organic EL display, with which the detection accuracy is high and it is possible to evaluate the organic EL display itself, before the finished product drive circuits have been incorporated into the organic EL display.

It is another object of the present invention to provide an apparatus and method for evaluating an organic EL display, with which pixel defects of organic EL display elements can be detected by efficiently detecting, with a simple circuit configuration, the micro-current flowing to the organic EL elements.

It is another object of the present invention to provide an apparatus and method for evaluating an organic EL display, with which the micro-current can be efficiently detected so that the drive current supplied to the organic EL elements for the purpose of detection does not become superposed between a number of organic EL elements.

It is yet another object of the present invention to provide an apparatus and method for evaluating an organic EL display, with which it is possible to suppress the decrease in yield caused by dealing with defective products due to the evaluation results.

Specifically, according to the present invention it is possible to test an active-matrix type organic EL display after assembly of the pixels, the signal lines, the selection lines, and the voltage supply lines by energizing each pixel in turn, measuring a first steady-state current flowing to the EL element after the associated capacitor has been charged through the first transistor, and the second transistor is switched on, by measuring a second steady-state current after the capacitor has been discharged and the second transistor is switched off, by comparing the two measured currents, and by identifying a pixel as defective or defect-free based on the difference between the two currents.

The first aspect of the invention is an apparatus for evaluating an organic EL display having organic EL elements as pixels, wherein the the first and second currents as defined above are measured for each pixel constituted by an organic EL element and pixel defects are identified by detecting a difference in the current values thereof.

The above organic EL display can have a constant current circuit for driving the organic EL elements, and a switch for switching the voltage in order to make the constant current produced by this constant current circuit variable.

The above organic EL display can have a constant current circuit such as TFT for driving the organic EL elements, and signal lines and selection lines for selecting the organic EL elements.

There can be provided signal lines and selection lines for selecting the organic EL elements, and the drive current and discharge current values can be measured by switching either the signal line or the selection line for each pixel constituted by an organic EL element.

There can be provided signal lines and selection lines for selecting the organic EL elements, and the signal line or the selection line can be switched for each pixel constituted by an organic EL element so that drive current is supplied to the organic EL elements and the charge stored in the organic EL elements is discharged.

There can be provided a capacitor for supplying a constant current to the organic EL elements, drive voltage can be supplied to each pixel constituted by an organic EL element, and the charge stored in the capacitor can be discharged.

There can be provided a first transistor that performs switching for supplying a constant current to the organic EL elements, and a second transistor that is switched by the first transistor and is connected to the organic EL elements, and the first transistor can be switched for each pixel constituted by an organic EL element, whereby the drive current is supplied to the organic EL elements over a first specific time, and the second transistor is kept in a non-conducting state over a second specific time following this first specific time.

There can be provided signal lines and selection lines for selecting the organic EL elements, and voltage supply lines for supplying voltage to the organic EL elements, the signal line or the selection line can be switched for each pixel constituted by an organic EL element, in a state in which this voltage supply line is ON, and the drive current and discharge current flowing to the organic EL elements can be measured.

There can be provided signal lines and selection lines for selecting the organic EL elements, the signal line or the selection line can be switched for each pixel constituted by an organic EL element, and the current supplied to the organic EL elements can be controlled and the first current and the second current flowing to the organic LE elements as defined above measured.

The second aspect of the invention is an apparatus for evaluating an organic EL display, especially applicable to an active matrix type thereof, having organic EL elements as pixels, signal lines and selection lines for selecting the organic EL elements, and voltage supply lines for supplying voltage to the organic EL elements, said evaluation apparatus having a detection or test voltage generation circuit that generates a detection voltage to the signal lines, selection lines, and voltage supply lines, a control signal generation circuit that generates a control signal for sequentially applying this detection voltage at a specific period to the signal lines, selection lines, and voltage supply lines, a connection switching circuit for connecting this control signal to the organic EL elements via the signal lines, selection lines, and voltage supply lines, a current detection circuit for detecting the first current and the second current flowing to the organic EL elements as defined above, and a detected decision circuit that decides whether the organic EL elements are defective or non-defective based on the detected current values.

The third aspect of the invention is an apparatus for evaluating an organic EL display having signal lines and selection lines arranged in a matrix, and organic EL elements as pixels connected to said signal lines and selection lines at the intersections between these signal lines and selection lines, wherein the signal line or the selection line is switched for each pixel constituted by an organic EL element, that organic EL element is energized, and the first and second current values as defined above are measured for said organic EL elements, and pixel defects are detected by detecting a difference in the current values thereof.

The fourth aspect of the invention is an apparatus for evaluating an organic EL display having signal lines and selection lines arranged in a matrix, and organic EL elements as pixels connected to said signal lines and selection lines at the intersections between these signal lines and selection lines, wherein the signal line or the selection line is switched for each pixel constituted by an organic EL element, and that organic EL element is energized, a first sampling is performed for the first current values as defined above, and a second sampling is performed for the second current current values as defined above, whereby the first and second current values are measured, and pixel defects are detected by detecting a difference in the current values thereof.

The fifth aspect of the invention is a method for evaluating an organic EL display having organic EL elements as pixels, wherein the first and second current values as defined above are measured for each pixel constituted by an organic EL element, and pixel defects are detected by detecting a difference in the current values thereof.

With the apparatus and method of the present invention for evaluating an organic EL display, the drive (i.e., the testing) of an element is performed after the discharge of the previous element after the supply of drive current to the various pixels (organic EL elements) of the organic EL display; that is, the difference is measured between the drive current and discharge current values of the organic EL elements, so the supply and discharge of drive current can be performed for each pixel (organic EL element), and the organic EL elements can be tested one at a time.

If the difference between the current values is under the specified level, it can be concluded that the organic EL element that constitutes a pixel is operating normally.

With the first aspect of the invention in particular, any difference between the drive current and discharge current values is detected for each pixel constituted by an organic EL element, so the next pixel (organic EL element) is always tested in the same way upon completion of the discharge of the previous pixel, the drive current value resulting from the previous detection does not remain in the next pixel, and successive evaluations can be carried out for all of the pixels in a reliable manner.

With the second invention in particular, there are provided a detection voltage generation circuit, a control signal generation circuit, a connection switching circuit for connecting to the organic EL display, a current detection circuit, and a defect decision circuit, so unlike with a conventional evaluation apparatus, in which a drive circuit was attached to the organic EL display and everything put together in a form similar to that of an actual finished product, the evaluation work can be carried out for just the organic EL display.

With the third aspect of the invention in particular, the signal line or the selection line is switched for each pixel constituted by an organic EL element connected at the various intersection between these signal lines and selection lines arranged in a matrix, and the difference between the first and second currents as defined above is detected, so each pixel can be evaluated quickly by selecting a signal line or selection line.

With the fourth aspect of the invention in particular, a first sampling is performed for the first current values within the drive time of the organic EL elements, and a second sampling is performed for the second current values at the end of the discharge time following this drive time, so it is possible to measure a current value that is suitable for the evaluation of each organic EL element.

With the fifth aspect of the invention in particular, just as with the first invention, detection is carried out for a given pixel (organic EL element) after completion of discharge of the previous pixel, so the drive current value resulting from the previous detection does not remain in the next pixel, and successive evaluations can be carried out for all of the pixels in a reliable manner.

DESCRIPTION OF THE PREFERRED EMBODIMENTS

Figure 5:
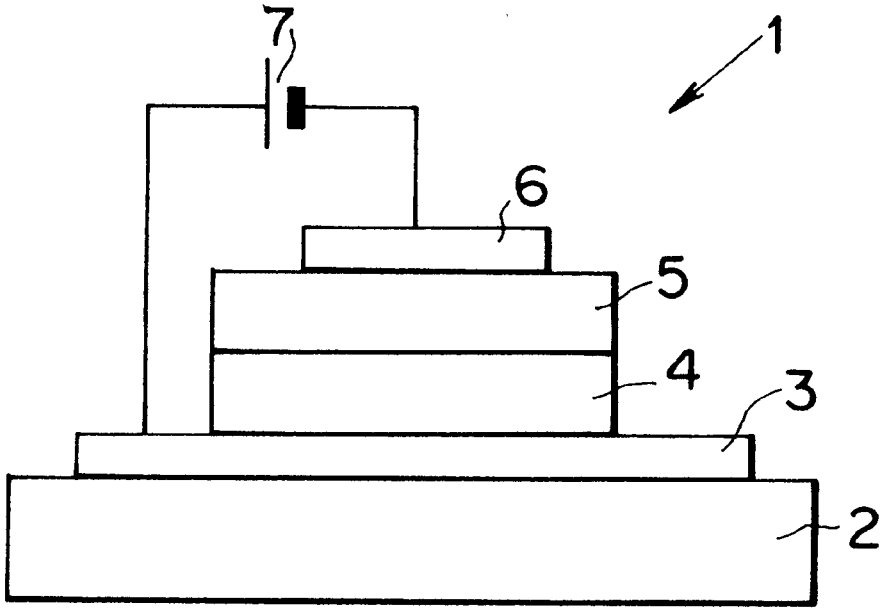
Fig.5 PRIOR ART
FIG. 5 is an enlarged cross section of the main components of a conventional type of organic EL element 1.
Figure 6:
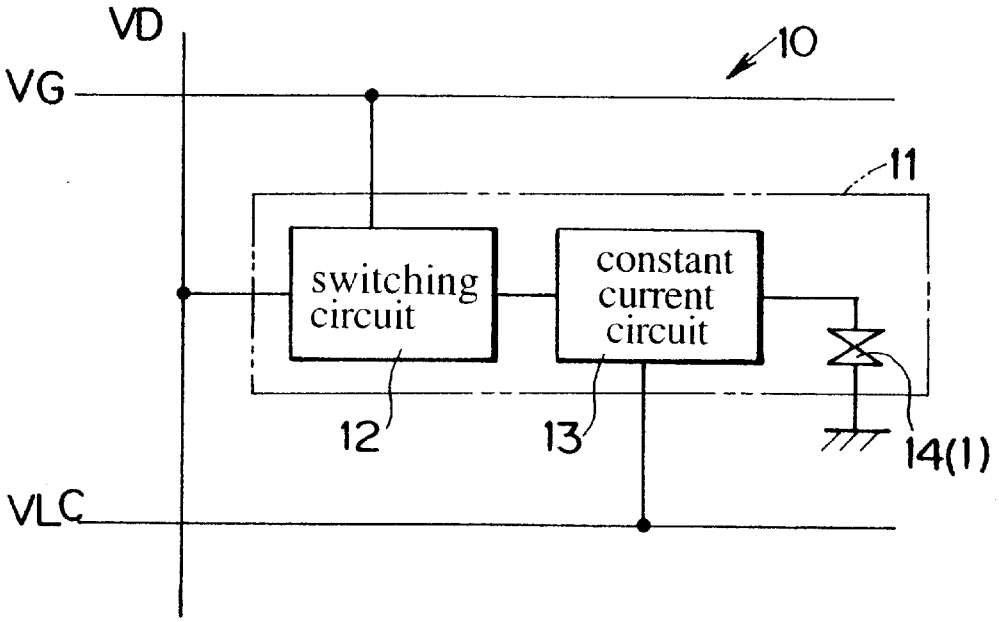
Fig.6 PRIOR ART
FIG. 6 is a circuit diagram of one pixel 11 in an active matrix type of organic EL display 10.
Figure 7:
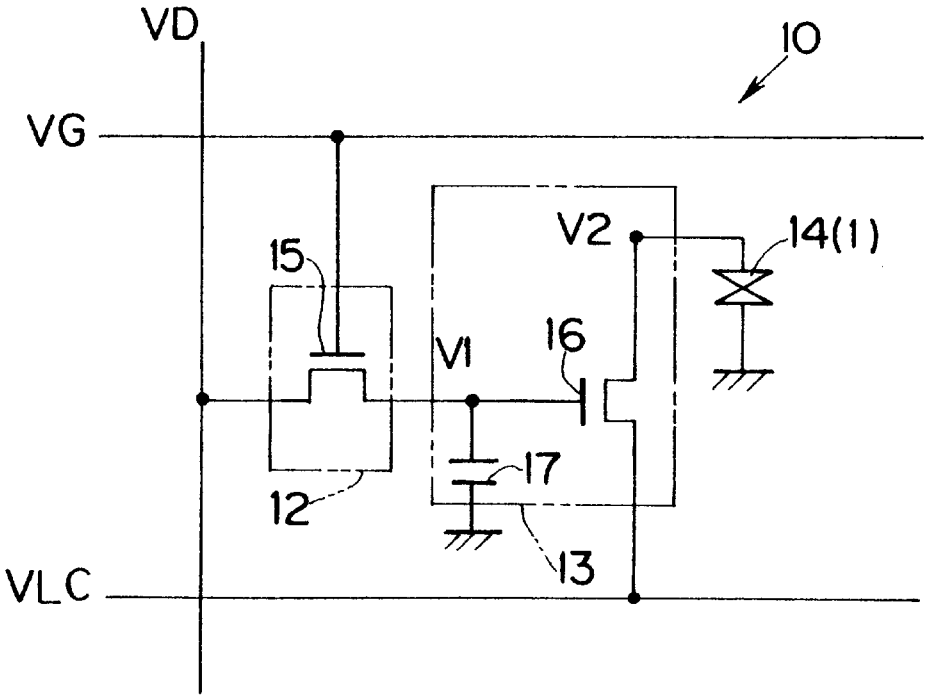
Fig.7 PRIOR ART
FIG. 7 is a circuit diagram of one pixel 11 in an active matrix type of organic EL display 10, shown in more detail than in FIG. 6.

Next, the organic EL display evaluation device 20 pertaining to the first embodiment of the present invention will be described along with an evaluation method through reference to FIGS. 1 to 4. Those components that are the same as in FIGS. 5 to 7 are numbered the same, and will not be described again in detail.

Figure 1:
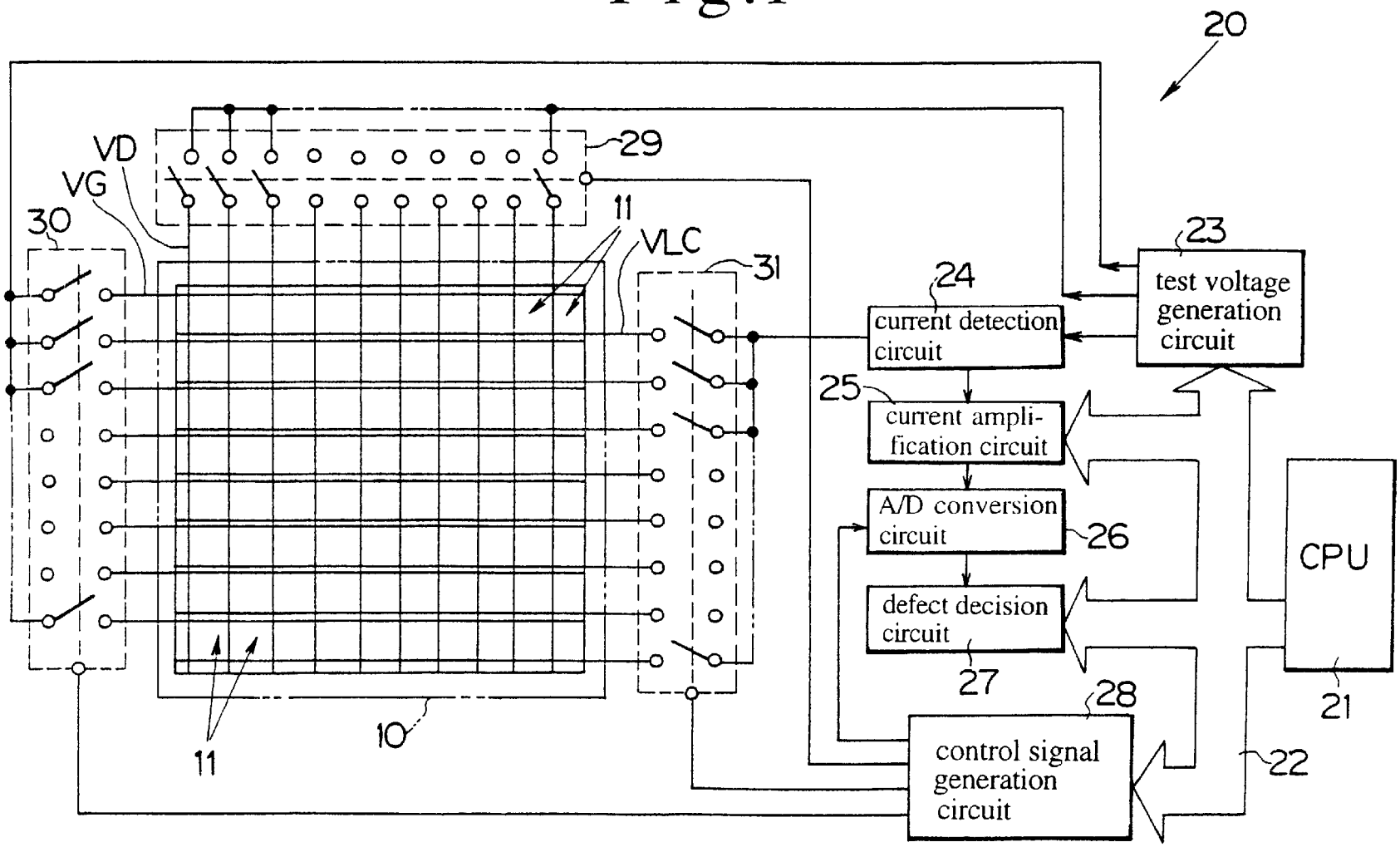
FIG. 1 is a schematic circuit diagram of an organic EL display evaluation device 20 pertaining to a first embodiment of the present invention.

FIG. 1 is a schematic circuit diagram of the evaluation device 20 for the organic EL display 10. The organic EL display evaluation device 20 evaluates the various pixels 11 of the organic EL display 10, the wiring thereof, and so forth to find whether these components are defective or non-defective, and comprises a central control circuit 21 (CPU), a control bus 22, a test voltage generation circuit 23, a current detection circuit 24, a current amplification circuit 25, an A/D conversion circuit 26, a defect decision circuit 27, a control signal generation circuit 28, a signal line connection switching circuit 29 (connection switching circuit), a selection line connection switching circuit 30 (connection switching circuit), and a voltage supply line connection switching circuit 31 (connection switching circuit).

The central control circuit 21 controls the overall system through the control bus 22.

The test voltage generation circuit 23 generates a test voltage for testing the organic EL display 10, and is connected to the signal line connection switching circuit 29, the selection line connection switching circuit 30, and the current detection circuit 24.

The test voltage should be low enough that it will not damage the organic EL display 10, and is preferably lower than the light-emitting voltage. A favorable voltage will allow the current required for evaluation of the organic EL display 10 to flow. The light-emitting voltage of the organic EL pixels 14 of the organic EL display 10 will vary with the organic materials and electrode materials being used, but is usually about 2 to 4 volts. The test voltage should therefore be generated at up to about 4 volts.

The test voltage generation circuit 23 should be capable of generating the desired voltage. For instance, the test voltage can be easily generated by using a constant voltage circuit, a regulator circuit, or the like.

The signal line connection switching circuit 29 serves to sequentially switch and connect signal lines VD in the organic EL display 10 to the various pixels 11, and the control signals for this switching are supplied from the control signal generation circuit 28.

The selection line connection switching circuit 30 serves to sequentially switch and connect selection lines VG in the organic EL display 10 to the various pixels 11, and the control signals for this switching are supplied from the control signal generation circuit 28.

The voltage supply line connection switching circuit 31 serves to sequentially switch and connect voltage supply lines VLC in the organic EL display 10 to the various pixels 11, and the control signals for this switching are supplied from the control signal generation circuit 28.

Therefore, the test voltage generation circuit 23 is able to supply its test voltage to the signal lines VD, the selection lines VG, and the voltage supply lines VLC through the signal line connection switching circuit 29 and selection line connection switching circuit 30, and through the current detection circuit 24 and voltage supply line connection switching circuit 31.

The current detection circuit 24 serves to detect test currents flowing to the pixels 11 (the organic EL pixels 14 or the organic EL elements 1), and is connected to the voltage supply line connection switching circuit 31 so that the detected current values will be outputted to the current amplification circuit 25.

The current amplification circuit 25 amplifies the detected current.

The A/D conversion circuit 26 converts the amplified current into a digital signal.

The defect decision circuit 27 decides whether the pixels 11 or organic EL pixels 14 (organic EL elements 1) in the organic EL display 10 are defective or non-defective on the basis of the detected current values (this will be described in detail through reference to FIG. 2).

The control signal generation circuit 28 supplies control signals to the A/D conversion circuit 26, signal line connection switching circuit 29, selection line connection switching circuit 30, and voltage supply line connection switching circuit 31.

Figure 2:
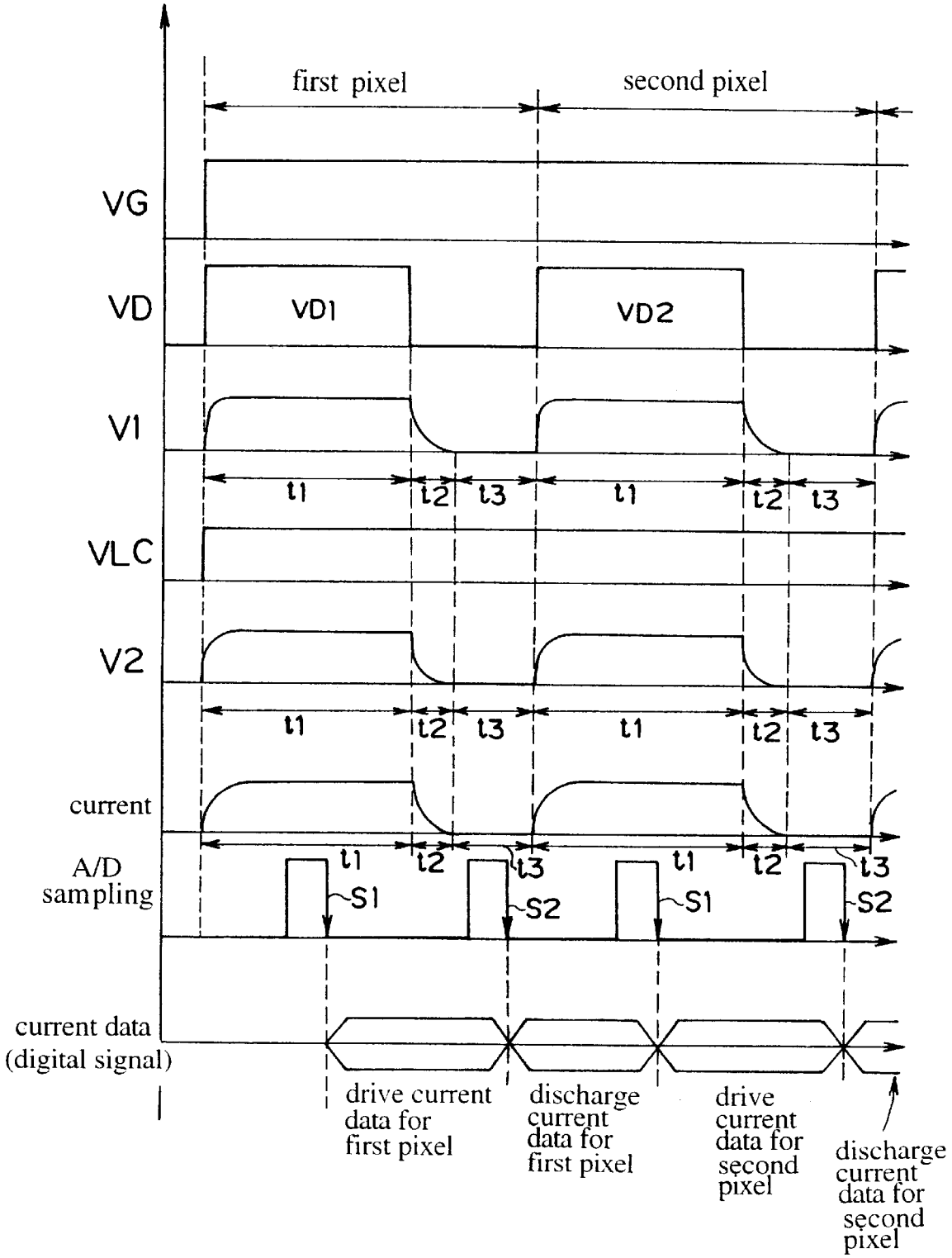
FIG. 2 is a timing chart for driving the organic EL display evaluation device 20 and evaluating the organic EL display 10.

FIG. 2 is a timing chart for driving the organic EL display evaluation device 20 and evaluating the organic EL display 10, and is drawn for first and second pixels.

In the testing of the organic EL pixel 14 in the pixels 11 of the organic EL display 10, upon completion of the testing of each pixel 11, the organic EL pixels 14 selected in this testing must be sufficiently discharged. Specifically, in the testing of the organic EL pixels 14, the timing is important as the signal lines VD, the selection lines VG, and the voltage supply lines VLC are switched on and off by the control signal generation circuit 28.

To describe this in specific terms through reference to FIGS. 1 and 2, at the start of testing, voltage is supplied to the selection line VG of a specific pixel 11 (first pixel) from the test voltage generation circuit 23 via the selection line connection switching circuit 30, which switches ON the first transistor 15 (FIG. 7), and voltage supplied to the signal line VD via the signal line connection switching circuit 29 rises to a value of VD1, which results in voltage V1 being supplied for driving the second transistor 16, switching ON the second transistor 16. The capacitor 17 is charged as this voltage V1 rises.

The voltage supply line VLC is switched ON in this state, and the voltage V2 to the organic EL pixel 14 rises to a steady-state value. Specifically, the test voltage is supplied to the organic EL pixel 14, and a first current of the organic EL pixel 14 as read by current detection circuit 24 is measured by performing a first sampling S1 within this time period t1.

After the first current has been measured, the signal line VD returns to its de-energized level, and the charge on capacitor 17 dissipates. After a time t2, the charge reaches a steady-state level and the second transistor 16 is switched completely OFF, and a second current is measured by performing a second sampling S2 within the time period t3.

Any difference between the above-mentioned first and second (drive current data) and this discharge current data is determined, and defect detection is performed for the organic EL pixel 14 (first pixel) on the basis of this difference in current values (operating current differential), that is, current data (digital signal) for the pixel current value.

Figure 3:
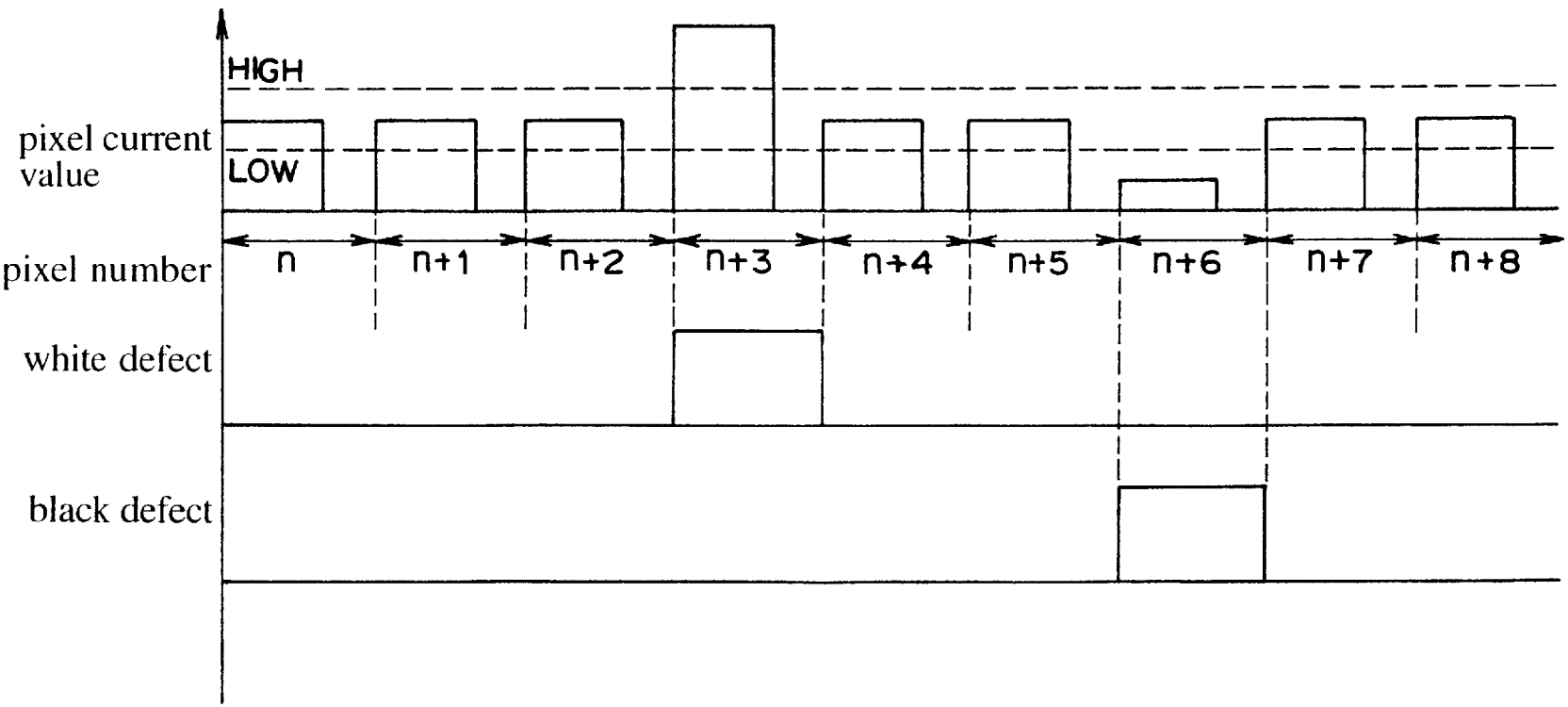
FIG. 3 is a graph of the pixel current values for the various organic EL pixels 14.

In specific terms, FIG. 3 is a graph of the pixel current values for the various organic EL pixels 14, and the evaluation standard value for the pixel current value is set to within a specific range.

For this specific range or threshold value, the average operating current differential of a properly operating organic EL pixel 14 is determined ahead of time, and any organic EL pixels 14 with a detected current value outside this range is deemed a defective pixel. For instance, if the upper limit of this range is exceeded, there may be a defect in the first transistor 15, the second transistor 16, or the wiring portion, and in the illustrated example, the n+3$^{rd}$ organic EL pixel 14 emits light too intensely, and is therefore deemed a white defect.

If the pixel current value drops under the lower limit of the range, the current itself may not flow well, and there may be a line defect or dot defect. For instance, the n+6$^{th}$ organic EL pixel 14 emits light too weakly, and is therefore deemed a black defect.

Thus, in the testing of the second pixel (organic EL pixel 14), it is possible to achieve a state in which no effect whatsoever remains of the first pixel drive state or test state, allowing proper and accurate pixel testing to be continued successively.

A drive circuit and other accessory parts are only added to an organic EL display 10 that has thus been evaluated to be normal, and this improves the yield in the manufacturing and evaluation steps.

Figure 4:
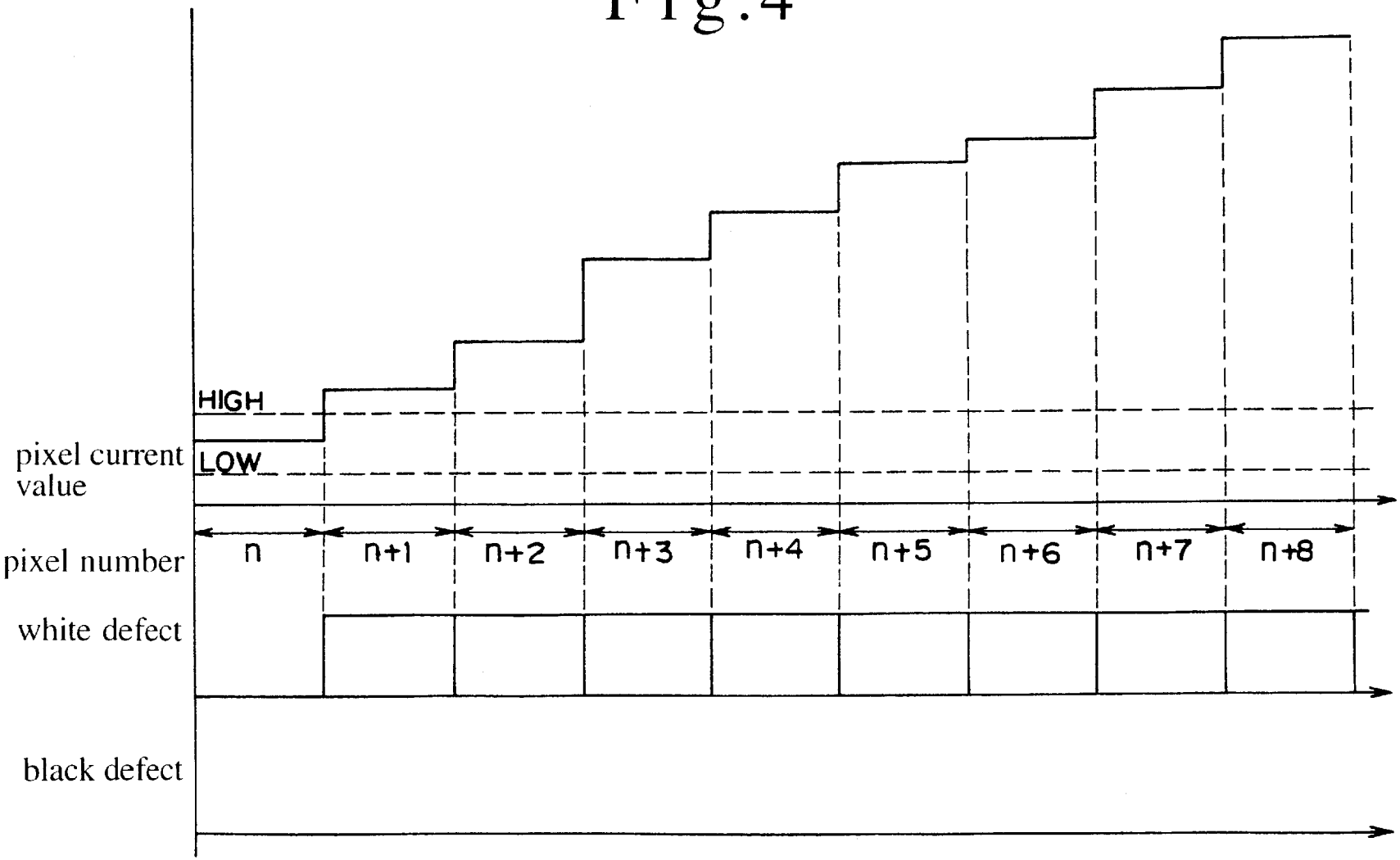
FIG. 4 is a graph as in FIG. 3, illustrating a testing procedure in which the next organic EL pixel 14 is tested without waiting for a fall time t2 and a discharge time t3 after the supply of drive current (after drive time t1)

FIG. 4 is a graph as in FIG. 3, illustrating a testing procedure in which the next organic EL pixel 14 is tested without waiting for the fall time t2 and the discharge time t3 after the supply of drive current (after the drive time t1), as discussed above. Because the superposition of the drive current occurs successively for each of the pixels, the pixel current value grows steadily larger, resulting in a white defect, and minute changes in a pixel current that has taken on a large absolute value mean that a defect decision must be made for each and every pixel 11, making the evaluation work either very difficult or impossible for all practical purposes.

Figure 8:
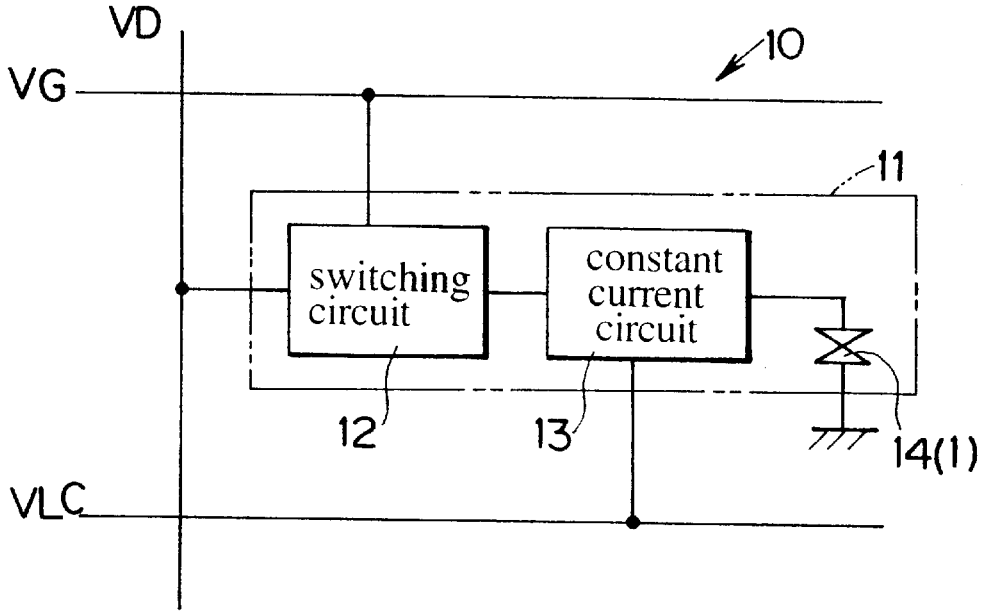
Figure 9:
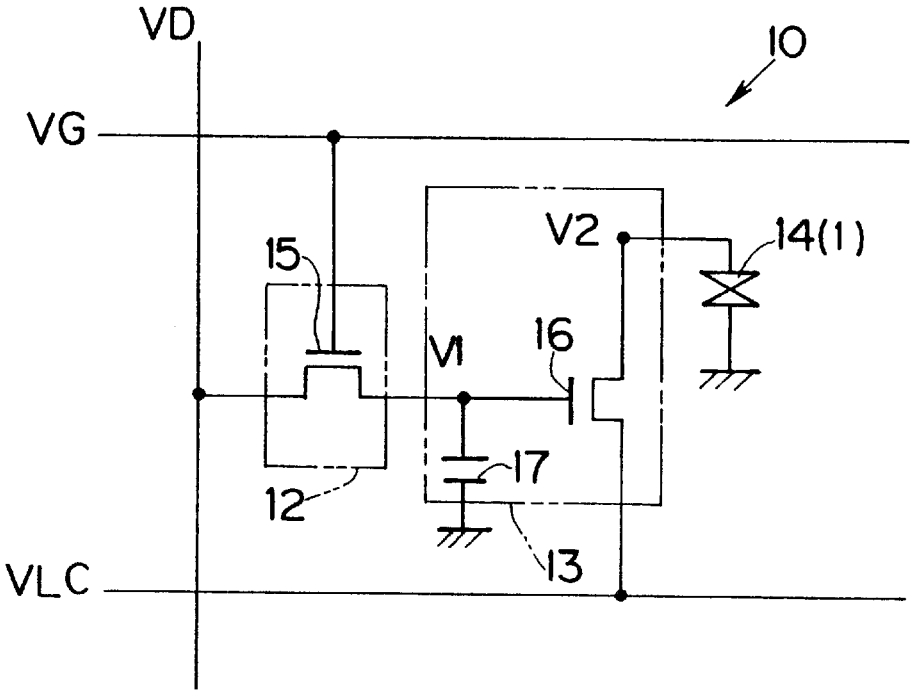

The apparatus and method for evaluating an organic EL display pertaining to the present invention are not limited to an active matrix type of organic EL display 10, and can also be applied to a simple matrix type of organic EL display 40 in which each organic EL pixel 14 is not equipped with the switching circuit 12 and the voltage supply line VLC (FIGS. 8 and 9).

Thus, with the present invention, the difference between the current in a pixel when it is energized and when it is de-energized is detected for the organic EL pixels or organic EL elements in an organic EL display, and a decision as to whether the organic EL display is defective or non-defective is made on the basis of this difference, allowing organic EL pixels to be properly evaluated one after the other.

What is claimed is:

1. An apparatus for evaluating an organic EL display which comprises: an array of pixels in which each pixel is connected to a respective one of a plurality of signal lines and to a respective one of a plurality of selection lines, in which each pixel includes a switch circuit, a constant current circuit and an organic EL element, with the switch circuit being operative to connect the signal line for the pixel to the constant current circuit when the selection line for the pixel is suitably energized, and in which the constant current circuit includes a capacitor which is charged and discharged based on a voltage on the signal line for the pixel when the selection line for the pixel is suitably energized, the capacitor supplying a constant current to the organic EL elements, according to a charge stored in the capacitor, the apparatus being comprised of:

a test voltage generation circuit which generates test signals;

a control circuit that controls the test voltage generation circuit to supply the test signals to the signal lines and selection lines to energize the organic EL elements of the pixels one at a time;

a current detection circuit which is operative to detect a first current flowing in an energized organic EL element when the capacitor in the pixel has been charged and to detect a second current flowing in the energized organic EL element when the capacitor in the pixel has been discharged; and a defect decision circuit which identifies a pixel as defective based on a difference between the first and second currents.

2. The apparatus according to claim 1, wherein:

the switch circuit for each pixel includes a first transistor which is switched between first and second conductive states depending on a voltage on the selection line for the pixel;

the constant current circuit for each pixel includes a second transistor having a gate terminal connected to the capacitor and a second terminal connected to the organic EL element;

the control circuit is further operative to establish a first predetermined period during which the voltage on the signal line for a pixel switches the first transistor to the first conductive state and charges the capacitor, and to establish a subsequent second predetermined period during which the first transistor is switched to the second conductive state and the capacitor discharges.

3. The apparatus according to claim 2, wherein in the defect decision circuit is operative to sample the first current during the first predetermined period after the capacitor is charged, and to sample the second current during the second predetermined period after the capacitor has discharged.

4. The apparatus according to claim 2, wherein the test voltage generation circuit supplies a test signal to one signal line at a time in a predetermined sequence, the test signal having a first value which places the first transistor in the first conductive state in which it supplies voltage for charging the capacitor, and a second value which places the first transistor in the second conductive state in which it supplies voltage for discharging the capacitor.

5. The apparatus according to claim 4, wherein:

the organic EL display further comprises a plurality of voltage supply lines which are respectively associated with the pixels to supply voltage to the organic EL elements thereof; and the control circuit is operative to connect a pixel including an organic EL element energized by one of the signal lines and one of the selection lines to the current detection circuit via the associated voltage supply line.

6. The apparatus according to claim 5, wherein the test current generation circuit supplies voltage in the forward direction of the organic EL element to one voltage supply line which is sequentially selected from the voltage supply lines.

7. The apparatus according to claim 5, wherein the control circuit is operative to generate first, second and third control signals for sequentially selecting one of the selection lines, one of the signal lines and one of the voltage supply lines over a specific period.

8. The apparatus according to claim 7, further comprising:

a first connection switch circuit which selects one of the selection lines based on the first control signal;

a second connection switch circuit which selects one of the signal lines based on the second control signal; and a third connection switch circuit which selects one of the voltage supply lines based on the third control signal.

9. A method for evaluating an organic EL display comprised of an array of pixels in which each pixel is connected to a respective one of a plurality of signal lines and to a respective one of a plurality of selection lines, in which each pixel includes a switch circuit, a constant current circuit and an organic EL element, with the switch circuit being operative to connect the signal line for the pixel to the constant current circuit when the selection line for the pixel is suitably energized, and in which the constant current circuit includes a capacitor which is charged and discharged based on a voltage on the signal line for the pixel when the selection line for the pixel is suitably energized, the capacitor supplying a constant current to the organic EL elements, according to a charge stored in the capacitor; the method comprising the steps of:

generating test voltages;

supplying the test voltages to the signal lines and the selection lines according to a sequence in which only one signal line and one selection line are simultaneously energized, whereby the organic EL elements are energized one at a time;

detecting a first current flowing to the organic EL element in a pixel when the capacitor in the pixel is charged and a second current flowing to the organic EL element in the pixel when the capacitor in the pixel is discharged; and detecting defects in each pixel based on a difference between the first and second currents.

10. The method according to claim 9, wherein the step of supplying test voltages further comprises the steps of:

switching a first transistor in the switching circuit to a first conductive state depending on a voltage on one of the selection lines; supplying voltage for charging the capacitor to one of the signal lines over a first predetermined period while the first transistor is in the first conductive state; and supplying voltage for discharging the capacitor to the signal line over a second predetermined period subsequent to the first predetermined period.

11. The method according to claim 9, wherein the evaluation is performed after assembly of the array, but before attachment thereto of peripheral drivers and further assembly of the organic EL display device.

12. The method according to claim 10, wherein the step of detecting the first and second currents further comprises the steps of:

sampling the first current during the first predetermined period after the capacitor is charged; and sampling the second current during the second predetermined period after the capacitor has discharged.

13. The method according to claim 10, wherein:

the organic EL display further comprises a plurality of voltage supply lines which are respectively associated with the pixels to supply voltage to the organic EL elements thereof; and the step of detecting the first and second currents further comprises:

sampling the first current and second currents via the voltage supply line which is associated with a pixel including an organic EL element energized by one of the signal lines and one of the selection lines.

14. The method according to claim 13, wherein the step of supplying test voltages further comprises:

supplying voltage in the forward direction of the organic EL element to one voltage supply line which is sequentially selected from the voltage supply lines.

15. The method according to claim 13, wherein the step of supplying test voltages further comprises:

sequentially selecting one of the selection lines, one of the signal lines and one of the voltage supply lines over a specific period.

16. An organic EL display which comprises:

an array of pixels in which each pixel is connected to a respective one of a plurality of signal lines and to a respective one of a plurality of selection lines, each pixel including:

an organic EL element;

a switch circuit operative to connect the signal line for the pixel to the constant current circuit when the selection line for the pixel is energized;

a constant current circuit which includes a capacitor which is charged and discharged based on a voltage on the signal line for the pixel when the selection line for the pixel is energized, the capacitor supplying a constant current to the organic EL elements, according to a charge stored in the capacitor; and a testing subsystem comprised of:

a test voltage generation circuit which generates test signals;

a control circuit that controls the test voltage generation circuit to supply the test signals to the signal lines and selection lines to energize the organic EL elements of the pixels one at a time;

a current detection circuit which is operative to detect a first current flowing to the energized organic EL element when the capacitor in the pixel has been charged and to detect a second current flowing to the energized organic EL element when the capacitor in the pixel has been discharged; and a defect decision circuit which identifies a pixel as defective based on a difference between the first and second currents.

17. An apparatus for evaluating an organic EL display which comprises: an array of pixels in which each pixel is connected to respective one of a plurality of signal lines and to a respective one of a plurality of selection lines, in which each pixel includes a switch circuit, a constant current circuit and an organic EL element, with the switch circuit being operative to connect the signal line for the pixel to the constant current circuit when the selection line for the pixel is suitably energized, and in which the constant current circuit includes a capacitor which is charged and discharged based on a voltage on the signal line for the pixel when the selection line for the pixel is suitably energized, the capacitor supplying a constant current to the organic EL elements, according to a charge stored in the capacitor, the apparatus being comprised of:

a test voltage generation circuit which generates test signals;

a delivery circuit that delivers the test signals to the signal lines and selection lines to energize the organic EL elements of the pixels;

a current detection circuit which is operative to detect a first current flowing in an energized organic El element when the capacitor in the pixel has been charged and to detect a second current flowing in the energized organic EL element when the capacitor in the pixel has been discharged; and a defect decision circuit which identifies a pixel as detective based on a difference between the first and second currents.

18. The apparatus according to claim 17, wherein in the defect decision circuit is operative to sample the first current during a first predetermined period after the capacitor is charged, and to sample the second current during a second predetermined period after the capacitor has discharged.

19. The apparatus according to claim 17, wherein the test voltage generation circuit supplies a test signal to one signal line at a time in a predetermined sequence, the test signal having a first value which places the first transistor in the first conductive state in which it supplies voltage for charging the capacitor, and a second value which places the first transistor in the second conductive state in which it supplies voltage for discharging the capacitor.

20. The apparatus according to claim 17, further including:

a first switching circuit that supplies a test signal to one signal line at a time in a predetermined sequence; and a second switching circuit that supplies a test signal to one selection line at a time in a predetermined sequence.

* * * * *